US005092660A

United States Patent [19]

Steinkuhl et al.

[11] Patent Number: 5,092,660

[45] Date of Patent: Mar. 3, 1992

[54] CUTTER BIT ASSEMBLIES AND ARRANGEMENTS FOR USE WITH MINING OR TUNNELLING MACHINES

[75] Inventors: Bernd Steinkuhl; Christoph Rassmann, both of Lunen; Oswald Breuer, Dortmund; Egon Pfefferle, Hamm, all of Fed. Rep. of Germany

[73] Assignee: Gewerkschaft Eisenhutte Westfalia, Fed. Rep. of Germany

[21] Appl. No.: 601,902

[22] Filed: Oct. 22, 1990

[30] Foreign Application Priority Data

Oct. 26, 1989 [DE] Fed. Rep. of Germany ..... 3935691

[51] Int. Cl.[5] ..... F21C 27/44

[52] U.S. Cl. ..... 299/91; 299/93

[58] Field of Search ..... 299/34, 79, 81, 91, 299/92, 93; 37/142 A; 175/413

[56] References Cited

U.S. PATENT DOCUMENTS 2,912,774 11/1959 McCrary ..... 299/91 X

FOREIGN PATENT DOCUMENTS 956513 4/1964 United Kingdom .

*Primary Examiner*—David J. Bagnell

*Attorney, Agent, or Firm*—Samuels, Gauthier & Stevens

[57] ABSTRACT

A cutter bit assembly for a mining or tunnelling machine has a cutter shank detachably fitted into a socket of a holder. To secure the shank in position a piston is displaced to cause pressure fluid to flow into a working chamber and act on a piston at one end of a rod-like securing element. The element is forced against a surface of the shank to urge the shank about a pivot and this in turn thrusts rear support surfaces of the cutter and the holder together. To release the cutter the pressure fluid is relieved and spring force displaces the securing element away from the shank. In this released condition, the cutter can be swivelled about the pivot and withdrawn from the socket.

20 Claims, 3 Drawing Sheets

CUTTER BIT ASSEMBLIES AND ARRANGEMENTS FOR USE WITH MINING OR TUNNELLING MACHINES

FIELD OF THE INVENTION

The present invention relates to cutter bit assemblies and arrangements for use with mineral winning machines, tunnel driving machines and the like.

BACKGROUND TO THE INVENTION

It is known with mineral winning machines, such as ploughs, which work by skimming or stripping a face as well as with machines such as shearers or partial cutting machines which have rotatable cutting heads to have cutters detachably supported in holders. These assemblies have been proposed in numerous constructions but only a comparative few of these have been adopted in practice. Normally the cutters are subjected to high load, particularly impacts, and wear and the cutters need replacement frequently sometimes even after just one working shift. The cutters need to be secured in their operating position reliably and yet the securing means must allow rapid release and replacement of the cutters. The securing means must also cope with the usual harsh and cramped conditions encountered in underground mine workings. Securing means of various kinds have been proposed such as pins, screws, keys, liners, sleeves, resilient or otherwise, multi-part or otherwise or combinations of these—see DE-PS 1239647, DE-GM 1941306, DE-OS 3242144, DE-AS 2244977, DE-OS 3209410, DE-GM 8633094, DE-OS 2929852 and DE-AS 1188016.

In the case of a coal plough, where accessibility is aggravated when the plough is standing close to the coal face, wedge elements has been used as a securing means for clamping the cutter bits in their holders, see DE-OS 3440448. Precautions must be taken in practice to prevent the wedge elements from becoming slack and falling out of the holders and this means that a rapid and trouble-free release for cutter bit replacement is not always possible.

A general object of the invention is to provide an improved cutter bit assembly and more particularly an improved means for securing the cutter bit in a holder.

SUMMARY OF THE INVENTION

In accordance with the invention an improved securing means for selectively locking a cutter in a holder is hydraulically actuated.

In an embodiment of the invention there is a securing element which is displaced by hydraulic pressure fluid to engage on a shank of the cutter in a socket of the holder. A servo-piston in a chamber in the holder can be displaced by the pressure fluid to effect a corresponding displacement of the securing element. The securing element can be one rod-like part of an elongate stepped component also having the servo-piston at an opposite end. However, the servo-piston can be separate from the securing element and coupled thereto directly or indirectly.

Conveniently, the securing element can be subjected to the action of spring force to release the element from its engagement with the cutter. The spring force can then oppose the force of the pressure fluid. Alternatively, the securing can be subjected to hydraulic force to cause its release and its locking. In another assembly the securing element is held in the locking position by spring force and is released by the hydraulic force. In this case the securing element can be a simple resilient clamping or locking piece which is resiliently deformed or moved by spring force to snap into an aperture or bore or the like in a cutter bit shank to secure the cutter bit.

An assembly constructed in accordance with the invention is characterized by easy rapid trouble-free release and replacement of the cutter while the cutter is reliably held and clamped during normal working. The securing element is retained in the holder and is simply displaced as required to effect clamping or release. No separate wedges or the like which have to be driven in from the exterior by hand are needed.

The charging of pressure fluid into the chamber in the holder can be realised in various ways. For example, pressure fluid can pass through an external connector and an associated non-return valve into the chamber. An outlet can then be opened selectively to relieve the pressure in the chamber. In a preferred arrangement a displacement piston in the same or another chamber is moved to force hydraulic fluid against the servo-piston. The displacement piston can be displaced by the use of a tool which rotates the piston which is in screw-threaded engagement with a guide for example. Conveniently, the displacement piston is formed as part of a component with a cylindrical head which engages or receives the tool. The displacement piston can be moved in other ways however e.g. via gearing, an eccentric or a wedge.

The relevant hydraulic system is expediently a closed one in which the pressure medium flows between or through the chamber or chambers accommodating the servo and displacement pistons.

The chamber accommodating the servo piston can be part of a stepped bore in a wall of the holder of the cutter assembly. A guide bush can be mounted in the stepped bore to guide and seal the securing element. Where a number of cutter assemblies are used, as for example with a coal plough, the chambers of the servo-pistons for several cutter bit assemblies can be connected to a common pressure medium supply so that a group of assemblies can all be locked and/or released hydraulically at the same time. This can be achieved by connecting the chambers of the assemblies which contain the servo-pistons to a common further filling chamber containing the displacement piston. In the case of the coal plough the common chamber can be in a pivotable flap-like tool carrier while the chambers for the servo-pistons would be in holders fixed to the carrier. The filling chamber is best disposed at an accessible upper region of the carrier.

A connection bore in the carrier can lead from the filling chamber to further bores in the holders of the cutter assemblies. A closure with a vent valve can be provided on the carrier for permitting the system to be filled with pressure fluid.

A cutter assembly in accordance with the invention and especially for a coal plough may have the shank of a cutter received in a socket of a holder and hydraulically actuable securing means as outlined above. In this case the cutter bit shank and part of the socket defining walls have co-operating surfaces which form a support and pivot bearing enabling the cutter bit to be swung in and out of the socket.

A rear wall portion of the socket preferably has an abutment surface which abuts a rear surface of the cutter in a manner such that when the securing element is operated to secure the cutter in place the cutter tends to pivot about the bearing to urge these rear abutment surfaces together. The rear wall portion can be strong and stout and the chamber with the servo-piston can be formed as part of a stepped bore in the rear wall portion. The securing element can be a rod with an end surface engageable with a surface of the cutter shank extending transversally to the direction of displacement of the securing element.

Conveniently, the co-operating surfaces which form the pivot bearing are composed of a convex surface of a front wall portion of the socket and of a concave recess in the cutter shank. These arcuate surfaces extend over more than 180° preferably 200° to 270°. An opening between the front wall portion of the socket and a bottom wall of the socket can receive a region of the cutter shank in a hook-like manner when the cutter is being fitted in the holder. A particularly strong rigid seating for the cutter bit in the socket and the holder is achieved and forces encountered during use tend to be transmitted to the rear abutment faces and not to the securing element. These rear faces are preferably inclined to open outwardly of the socket.

In one aspect the invention provides a cutter assembly comprising a cutter with a shank, a holder with a socket for receiving the shank and means for securing the shank in the socket wherein the securing means is composed of a securing element actuable to selectively engage with the shank of the cutter bit and hydraulic means for actuating the securing element.

In another aspect the invention provides a cutter arrangement for a plough, said arrangement comprising a tool carrier, holders with sockets, cutter bits with shanks fitted in the sockets of the holders, means for securing the shanks of the cutter bits in the sockets, said securing means comprising securing elements displaceable within the holders to engage the shanks of the cutter bits and hydraulic means for actuating the securing elements wherein the hydraulic means comprises chambers in the holders containing pistons displaceable with pressure fluid to act on the securing elements and a common hydraulic pressure medium supply for all the chambers.

The invention may be understood more readily, and other aspects and features of the invention may become apparent from consideration of the following description.

BRIEF DESCRIPTION OF DRAWINGS

Embodiments of the invention will now be described, by way of examples only, with reference to the accompanying drawings, wherein.

DESCRIPTION OF PREFERRED EMBODIMENTS

Figure 4:
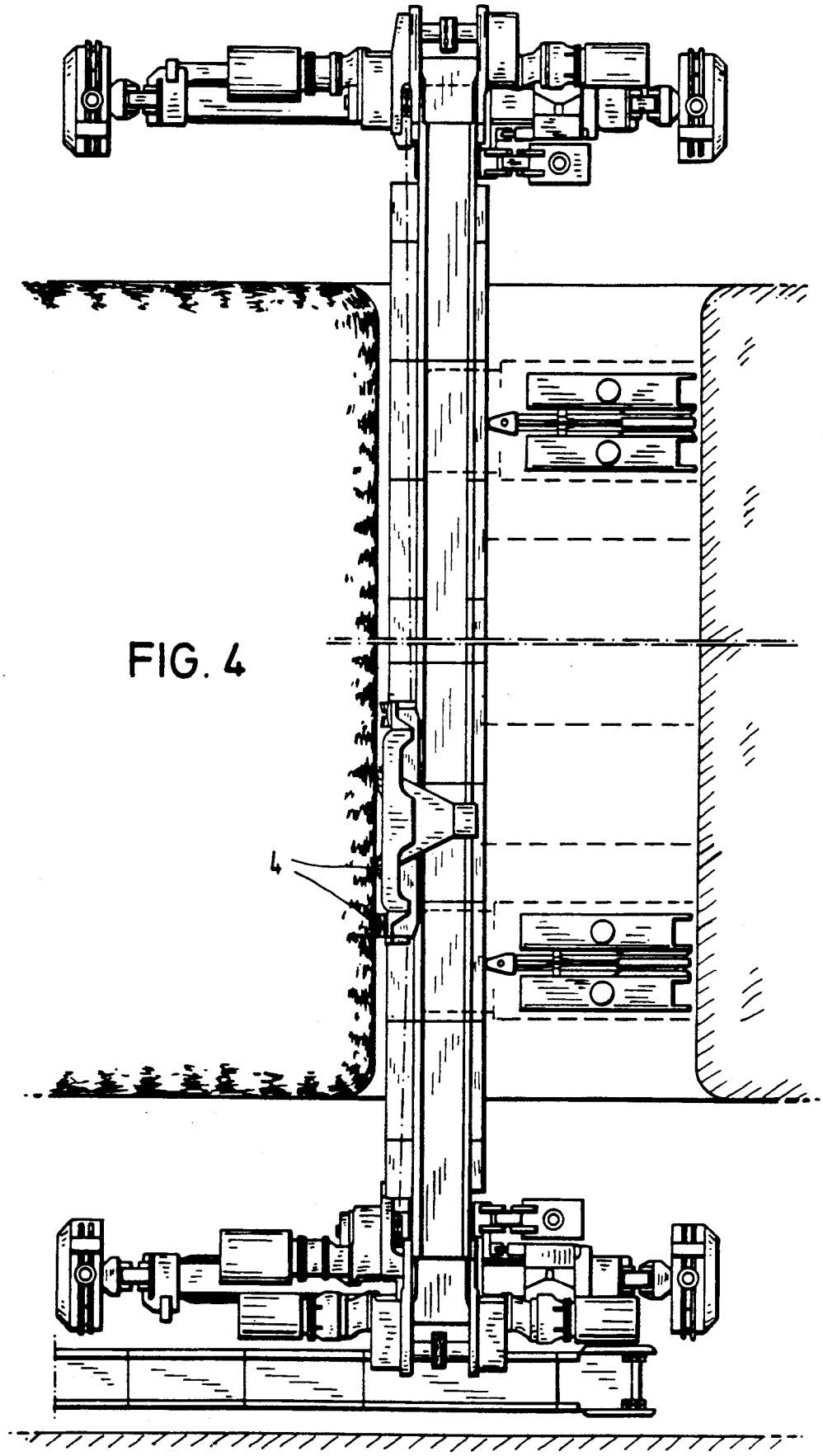
FIG. 4 is a schematic plan view of a mineral mining installation employing cutter bit assemblies and arrangements in accordance with the invention.

Referring initially to FIG. 4, there is represented a typical mineral, e.g. coal, winning installation with a scraper-chain conveyor C extending alongside a mineral, e.g. coal face F. A winning machine in the form of a plough P is guided on the conveyor C for movement back and forth along the face F to strip mineral therefrom. Drive stations S at the ends of the working serve to drive the plough and a scraper-chain assembly of the conveyor. As is known, the plough P has a main body with tool carriers at its ends. The carriers are pivotable in relation to the main body of the plough and sets of cutter bits are detachably mounted in holders of the carriers. The cutter bits are usually arranged one above another and staggered in relation to their cutting edges. The carriers can take the form of strips or flaps and swing between an operative working position whereat the cutter bits contact the face F and an inoperative position whereat the cutter bits do not contact the face F. The invention is concerned primarily with a tool or cutter assembly and arrangement usable in such an installation and with such a plough.

Figure 1:
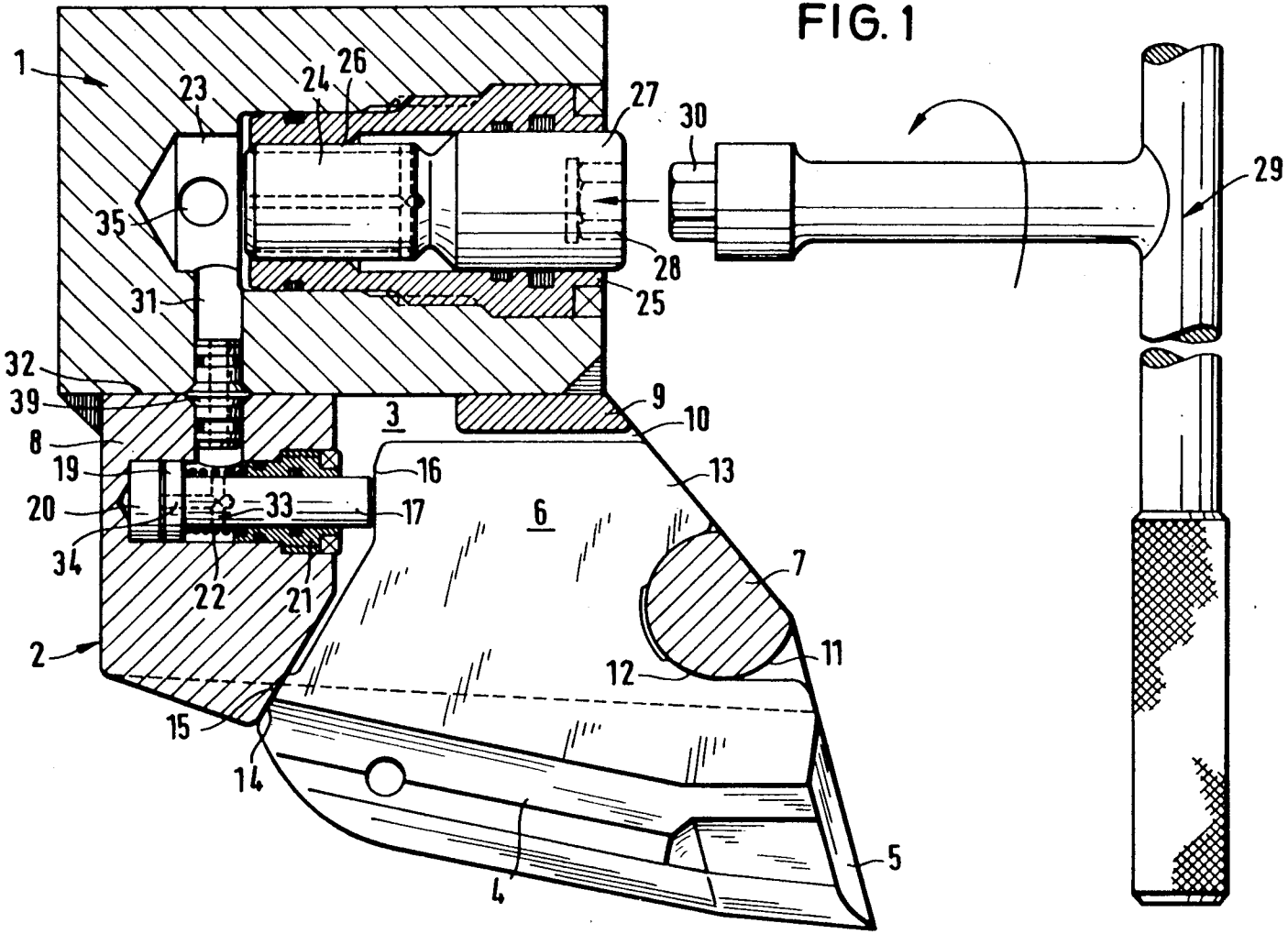
FIG. 1 is a part-sectional side view of a cutter bit assembly constructed in accordance with the invention.

As shown in FIG. 1, a carrier 1, such as a strip or flap of a plough, has a cutter bit holder 2 welded thereto. The carrier 1 and the holder 2 have plane abutting faces 32. The holder 2 is preferably a one-piece casting which defines a socket 3 for receiving a plate-like shank 6 of a cutter bit 4. The cutter bit 4 has a head region projecting outwardly of the socket 3 and a cutting edge 5 is provided on the head. The socket 3 is open towards the working face F and is defined by a wall portion 7 positioned nearest the cutting direction of the cutter bit 4, an opposite stout rear wall portion 8 facing towards the rear of the cutting direction, a bottom wall portion 9 which is welded to the carrier 1 and parallel side wall portions extending between the wall portions 7, 8, 9 to close off the socket 3. An opening 10 is present between the wall portions 7 and 9. The wall portion 7 is shaped to provide an abutment and guide surface 11 extending around and into the socket 3. The surface 11 is preferably arcuate as shown extending through an angle of about 270°. The surface 11 provides a pivot and support bearing for the cutter bit 4 and the shank 6 of the cutter bit 4 has a corresponding support surface 12 which engages on the surface 11 of the wall portion 7. The creation of the recess in the shank 6 providing the surface 12 leaves a projection 13 which engages behind the wall portion 7 in a hook-like manner to fit in the opening 10.

FIG. 1 shows the cutter bit 4 fitted into the holder 2 with a rear surface 14 of the head of the cutter bit 4 engaging on a support surface 15 on the wall portion 8 of the holder 2. As the plough P moves along the face F the reactive forces are transferred through the cutter bit 4 to the rear wall portion 8 of the holder 2. The surface 15 is inclined outwardly of the socket 3 and the surface 14 is correspondingly inclined.

Inwardly of the socket 3 the shank 6 of the cutter bit 4 has a support surface 16 and an adjustable securing element 17 engages on the surface 16 to fix the shank 6 securely in the socket 3. The surface 16 preferably extends more or less perpendicularly to the direction of movement of the element 17. The surface 16 would in most cases also extend approximately perpendicularly to the working face F. The construction and operation of the securing element 17 will be described hereinafter.

Figure 2:
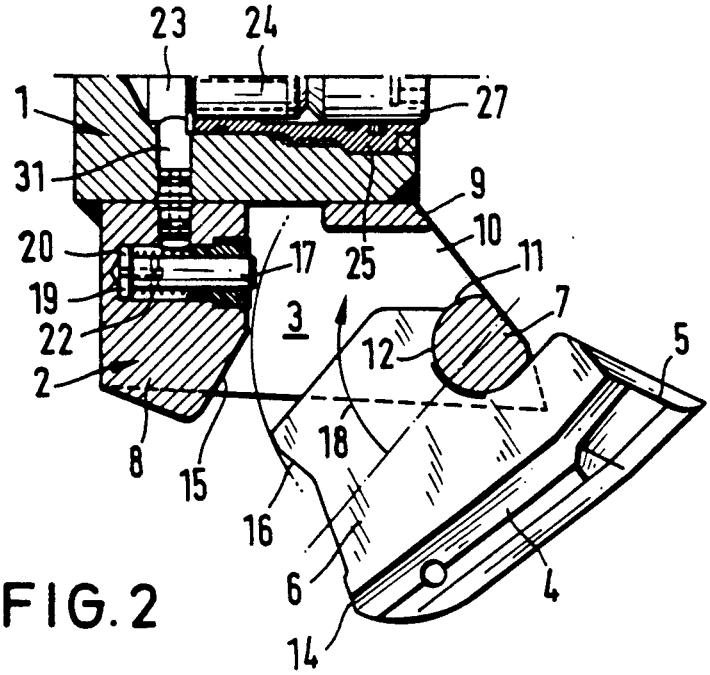
FIG. 2 is a part-sectional side view of part of the cutter bit shown in FIG. 1 with the cutter bit being fitted in position.

Turning now to FIG. 2, the operation of inserting the cutter bit 4 into the socket 3 of the holder 2 will be described. As shown, with the securing element 17 retracted into an unlocked position, the shank 6 of the cutter bit 4 is placed with the recessed surface 12 engaging the surface 11 and the cutter bit 4 is then swung in the direction of arrow 18 with the surfaces 12, 11 sliding over one another. Once the shank 6 pivots into the socket 3 sufficient for the rear surface 14 to abut the face 15, the element 17 can be extended into the socket 3 to secure the cutter bit 4 in the working position as shown in FIG. 1. When it is desired to withdrawn and remove the cutter bit 4 the element 17 is retracted into the unlocked position (FIG. 2) and the cutter bit 4 is swung out in the direction opposite to arrow 18.

Returning back to FIG. 1, the securing element 17 is displaceable eccentrically to the pivot bearing 11 and the axis of pivotal movement of the cutter bit 4 so as to exert on the shank 6 a torque which tends to press the support faces 14, 15 together. In accordance with the invention the securing element 17 is operated hydraulically and this can be achieved by connecting the element 17 to a servo-piston 19 in a chamber 20. Conveniently, the element 17 and the piston 19 are formed as a one-piece rod component with a larger diameter region providing the piston 19 and a longer smaller diameter region providing the element 17. The chamber 20 is part of a stepped bore in the wall portion 8 of the holder 2 in which a guide bush 21 with seals is screwed-in from the socket 3. The guide bush 21 receives the element 17 and sealingly and slidably engages with its peripheral surface. A compression spring 22 is disposed between the bush 21 and the piston 19 to bias the piston 19 and load the element 17 into the retracted unlocked position.

The carrier 1 is also provided with a stepped bore providing a chamber 23 containing pressure fluid and a region accommodating a guide bush 25 with seals which is screwed-in from the outside. A displacement piston 24 is accommodated in the guide bush 25 and can be moved in and out of the chamber 23 to displace the pressure fluid. The chamber 23 is connected with a passage or bore 31 to the chamber 20 via a sealed nipple piece 39 to ensure no leakage between the abutting faces 32 of the holder 2 and the carrier 1. The passage 31 leads to the annular side of the piston 19 and radial bores 33 and an axial bore 34 in the component 17, 19 establishes connection with the chamber 20 and the working face side of the piston 19. The piston 24 is formed as part of a one-piece component which has a plug-like outer head portion 27. The bush 25 and the piston 24 have interengaging screw-threads 26 so that rotation of the component will cause the piston 24 to move as described. The head 27 has a hexagonal recess 28 which can receive a hexagonal plug 30 of a spanner or similar implement 29 used to rotate the component and displace the piston 24.

The hydraulic system composed of the chambers 20, 23 and the connections therebetween is a closed system and if the piston 24 is adjusted with the implement 29 to extend into the chamber 23 pressure fluid is forced from the chamber 23 into the chamber 20 and the piston 19 is displaced as a consequence. The element 17 will thus be urged outwardly against the restoring force of the spring 22 into the locking position (FIG. 1). The element 17 is hydraulically locked and the cutter bit 4 reliably secured in the holder. To release the element 17, the implement 29 is used to withdraw the piston 24 from the chamber 23 so that the pressure fluid can be discharged by the displacement of the pistons 19, under the force of the spring 22, from the chamber 20 to the chamber 23.

Figure 3:
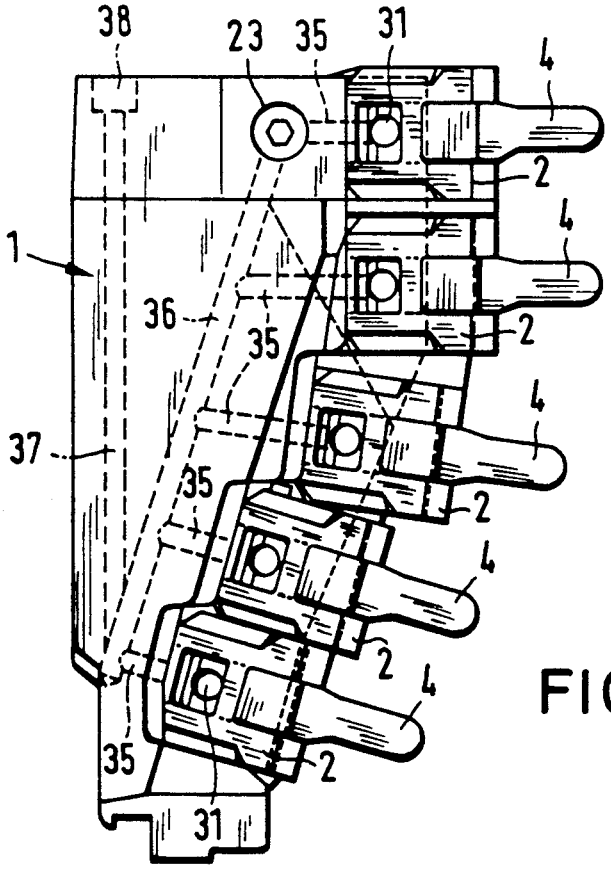
FIG. 3 is a side view of an arrangement of cutter bit assemblies constructed in accordance with the invention.

FIG. 3 shows a number of holders 2 with cutter bits 4 arranged one above another on a carrier 1. The holders 2 and the cutter bits 4 are similar to one another and correspond to the construction shown in FIGS. 1 and 2. Thus, the rear wall portions 8 of the holders 2 have chambers 20 with the servo-pistons 19 and the associated securing elements 17. The chambers 20 of the holders 2 are here connected by way of transverse bores 35 in the carrier 1 to a common bore 36 which leads to a common chamber 23 with the displacement piston 24. Thus by actuating a single displacement piston 24 the chambers 20 of all the holders 2 can be charged or relieved at the same time thereby to lock in or release the cutter bits 4. As shown, the bore 36 is connected with a bore 37 which leads to an upper side of the carrier 1 and is closed with a closure 38. When the closure 38 is released the entire hydraulic system can be filled with pressure medium. The bore 37 can also act to vent off air and preferably an air vent valve can be incorporated in the closure 38. These measures are quite optional since the hydraulic system can be filled with pressure medium by removing the piston 24 or via some other bore in the carrier 1. Although the securing element 17 and the servo-piston 19 are conveniently formed as one-piece as described this is not essential since this element 17 and the piston 19 can be separate parts connected together directly or indirectly, e.g. via gearing.

We claim:

1. In a cutter assembly for a mineral winning machine or a tunnel driving machine, said assembly comprising a cutter with a shank and a holder with a socket for receiving the shank of the cutter and means for securing the shank in the socket said securing means comprises a securing element actuable to selectively engage with the shank of the cutter bit and hydraulic means for actuating the securing element, wherein said hydraulic means comprises a first chamber in the holder and a servo piston which can be subjected to pressure medium in said first chamber, and a second chamber having a displacement piston movable in said second chamber to cause pressure medium to flow between the chambers.

2. An assembly according to claim 1, wherein the servo piston is connected to the securing element.

3. An assembly according to claim 1, wherein a stepped bore in the holder provides at least the first chamber and a region of the stepped bore receives a guide bush which sealably contacts and guides the securing element.

4. An assembly according to claim 1, wherein the displacement piston is moved by manually rotatable means.

5. An assembly according to claim 1, wherein the servo piston acts to urge the securing element against the cutter shank when subjected to pressure medium and there if further provided a spring for opposing the action of the piston and for biasing the securing element away from the cutter shank.

6. An assembly according to claim 1, wherein the hydraulic means employs a closed hydraulic system.

7. An assembly according to claim 1, wherein the hydraulic means acts on the securing element against the force of a spring.

8. An assembly according to claim 1, wherein the second chamber is part of a stepped bore, a guide bush is received in the stepped bore and a component is received in the guide bush with screw-threaded engagement therebetween the component forming the displacement piston and providing a cylindrical head accessible for manual rotation with a tool.

9. A cutter arrangement for a plough, said arrangement comprising a tool carrier, holders with sockets supported by the carrier, cutter bits with shanks fitted in the sockets of the holder, means for securing the shanks of the cutter bits in the sockets, said securing means comprising securing elements displaceable within the holders to engage the shanks of the cutter bits and hydraulic means for actuating the securing elements wherein the hydraulic means comprises chambers in the holders containing pistons displaceable with pressure fluid to act on the securing elements and a common hydraulic pressure medium supply for all the chambers.

10. An arrangement according to claim 9, wherein the supply comprises a further chamber in the carrier containing a displacement piston which is operated to cause pressure fluid to flow to all the chambers of the holders.

11. An arrangement according to claim 10, wherein a common connecting bore in the carrier connects the further chamber to individual bores leading to the chambers in the holders and the connection bore leads to an access bore with a detachable closure which can be removed to introduce hydraulic pressure fluid.

12. An arrangement according to claim 11, wherein the closure is provided with an air vent valve.

13. In a cutter assembly for a mineral winning machine or a tunnel driving machine, said assembly comprising a cutter with a shank and a holder with a socket for receiving the shank of the cutter and means for securing the shank on the socket; said securing means comprises a securing element actuable to selectively engage with the shank of the cutter bit and hydraulic means for actuating the securing element, wherein the hydraulic means comprises a first chamber in the holder, a servo piston which can be subjected to pressure medium in this first chamber and a second chamber from which pressure medium can be caused to flow to the first chamber to displace the servo piston, the servo piston and the securing element are parts of a one-piece component and axial and radial borings in the one-piece component connect the first chamber to another bore leading to the second chamber.

14. In a cutter assembly for a mineral winning machine or a tunnel driving machine, said assembly comprising a cutter with a shank and a holder with a socket for receiving the shank of the cutter and means for securing the shank on the socket; said securing means comprises a securing element actuable to selectively engage with the shank of the cutter bit and hydraulic means for actuating the securing element, wherein the socket of the holder has a rear wall portion with an abutment surface engageable with an abutment surface of the cutter and the securing element acts to secure the cutter by urging those abutment surfaces together.

15. An assembly according to claim 14, wherein the socket has a front wall portion with a curved surface engageable with a correspondingly curved surface of the shank of the cutter and the curved surfaces form a pivot and support bearing about which the cutter can be swivelled to insert the cutter shank into, or withdraw the cutter shank from the socket.

16. An assembly according to claim 15, wherein the curved surface of the front wall portion is convex and the curved surface of the shank of the cutter is concave.

17. An assembly according to claim 16, wherein the socket has a bottom wall portion, an opening is defined between the front wall portion and the bottom wall portion and the shank of the cutter has a region which engages in a hook-like manner in the opening.

18. An assembly according to claim 15, wherein the shank of the cutter has a surface engageable with the securing element and the securing element acts about the pivot and support bearing to urge the abutment surfaces together to secure the cutter in the holder.

19. An assembly according to claim 18, wherein the surface of the shank engageable with the securing element extends substantially perpendicular to the direction of movement of the securing element.

20. An assembly according to claim 14, wherein the abutment surfaces are inclined outwardly of the socket.

* * * * *